US010107281B2

(12) United States Patent
Tanaka et al.

(10) Patent No.: US 10,107,281 B2
(45) Date of Patent: Oct. 23, 2018

(54) PIEZOELECTRIC BLOWER

(71) Applicant: Murata Manufacturing Co., Ltd., Kyoto (JP)

(72) Inventors: Nobuhira Tanaka, Kyoto (JP); Daisuke Kondo, Kyoto (JP); Kiyoshi Kurihara, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 183 days.

(21) Appl. No.: 14/858,737

(22) Filed: Sep. 18, 2015

(65) Prior Publication Data

US 2016/0010636 A1 Jan. 14, 2016

Related U.S. Application Data

(63) Continuation of application No. PCT/JP2014/051459, filed on Jan. 24, 2014.

(30) Foreign Application Priority Data

Mar. 22, 2013 (JP) ..... 2013-060532

(51) Int. Cl.
*F04B 45/04* (2006.01)
*F04B 45/047* (2006.01)
(Continued)

(52) U.S. Cl.
CPC ..... *F04B 45/047* (2013.01); *F04B 43/046* (2013.01); *F04B 53/08* (2013.01); *F04F 7/00* (2013.01)

(58) Field of Classification Search
CPC ..... F04F 7/00; F04B 45/047; F04B 53/08; F04B 43/046; F04B 45/04
See application file for complete search history.

(56) References Cited

U.S. PATENT DOCUMENTS

2008/0170951 A1* 7/2008 Satoh ..... F04B 43/04 417/413.2
2010/0239444 A1* 9/2010 Nagao ..... F04B 43/046 417/413.2
(Continued)

FOREIGN PATENT DOCUMENTS

JP 2005-207406 A 8/2005
JP 2010-138911 A 6/2010
(Continued)

OTHER PUBLICATIONS

English translation of Written Opinion of the International Searching Authority for PCT/JP2014/051459 dated Aug. 4, 2014.
(Continued)

*Primary Examiner* — Peter J Bertheaud
*Assistant Examiner* — Dnyanesh Kasture
(74) *Attorney, Agent, or Firm* — Pearne & Gordon LLP

(57) ABSTRACT

A piezoelectric blower includes an outer casing and a blower main body. The outer casing houses the blower main body. The blower main body includes a top plate, side plate, first vibrating plate, piezoelectric element, intermediate plate, second vibrating plate, side plate, and bottom plate and has a structure in which they are laminated in sequence. The top plate, side plate, and first vibrating plate define a columnar first blower space. The second vibrating plate, side plate, bottom plate define a columnar second blower space. The distance from a neutral plane of the piezoelectric element in the thickness direction to a surface of the second vibrating plate, the surface being near the piezoelectric element, is longer than the distance from the neutral plane to a surface of the first vibrating plate, the surface being near the piezoelectric element.

12 Claims, 9 Drawing Sheets

(51) Int. Cl.

| | |
|---|---|
| ***F04B 43/04*** | (2006.01) |
| ***F04B 53/08*** | (2006.01) |
| ***F04F 7/00*** | (2006.01) |

(56) References Cited

U.S. PATENT DOCUMENTS

| | | | | |
|---|---|---|---|---|
| 2010/0260623 | A1 | 10/2010 | Ikushima et al. | |
| 2011/0076170 | A1 | 3/2011 | Fujisaki et al. | |
| 2012/0140414 | A1* | 6/2012 | Ishikawa | F04F 7/00 361/691 |
| 2013/0236338 | A1* | 9/2013 | Locke | F04B 43/023 417/413.1 |
| 2014/0178220 | A1 | 6/2014 | Fujisaki et al. | |

FOREIGN PATENT DOCUMENTS

| | | | |
|---|---|---|---|
| JP | 2011-241808 | A | 12/2011 |
| WO | 2009-148008 | A1 | 12/2009 |

OTHER PUBLICATIONS

International Search Report for PCT/JP2014/051459 dated Apr. 8, 2014.

* cited by examiner

PIEZOELECTRIC BLOWER

BACKGROUND OF THE DISCLOSURE

Field of the Disclosure

The present disclosure relates to a piezoelectric blower that transports gas.

Description of the Related Art

There are various types of piezoelectric blowers for cooling heat sources in electronic devices or for supplying oxygen required to generate power in fuel cells. One example is a piezoelectric blower 900 disclosed in Patent Document 1.

FIG. 9 is a cross-sectional view of the piezoelectric blower 900 in Patent Document 1. The piezoelectric blower 900 includes an inner casing 1 and an outer casing 5.

The inner casing 1 includes a diaphragm 21 to which a piezoelectric element 20 and an intermediate plate 22 are bonded, a frame plate portion 13 bonded to the diaphragm 21, and a top plate portion 10 bonded to the frame plate portion 13. In the inner casing 1, the diaphragm 21, the frame plate portion 13, and the top plate portion 10 define a blower space 3.

The top plate portion 10 has a first vent 11 communicating between the inside and outside of the blower space 3 and includes a plurality of supporting portions 4 fixed on the outer casing 5. The plurality of supporting portions 4 elastically support the inner casing 1 with respect to the outer casing 5.

The outer casing 5 covers the inner casing 1 such that a gap is disposed therebetween. An airway 6 is defined between the outer casing 5 and the inner casing 1. The outer casing 5 has a second vent 8 in a location opposed to the first vent 11.

The piezoelectric element 20 has a first principal surface 20A and a second principal surface 20B opposed to the first principal surface 20A. An electrode for driving the piezoelectric element 20 is disposed on each of the first principal surface 20A and the second principal surface 20B. The top plate portion 10 includes an electrode terminal 83 protruding from the outer casing 5. The electrode terminal 83 and the electrode on the first principal surface 20A of the piezoelectric element 20 are electrically connected to each other with the intermediate plate 22 and the inner casing 1 disposed therebetween. An electrode terminal 82 is disposed on the bottom surface of the outer casing 5. The electrode terminal 82 and the electrode on the second principal surface 20B of the piezoelectric element 20 are electrically connected to each other with a lead wire 79 disposed therebetween.

In the above configuration, when an alternating drive voltage is applied from the electrode terminals 82 and 83 to the piezoelectric element 20, the piezoelectric element 20 expands and contracts, and the expansion and contraction of the piezoelectric element 20 causes the diaphragm 21 to bend and vibrate. The bending vibration of the diaphragm 21 changes the volume of the blower space 3 periodically.

Specifically, when the diaphragm 21 bends toward the piezoelectric element 20, the volume of the blower space 3 increases. With this, gas outside the piezoelectric blower 900 is sucked into the blower space 3 through the airway 6 and the first vent 11.

Then, when the diaphragm 21 bends toward the blower space 3, the volume of the blower space 3 reduces. With this, gas inside the blower space 3 is discharged from the second vent 8 through the airway 6 and the first vent 11. At this time, the air outside the piezoelectric blower 900 is drawn through the airway 6 by the air discharged from the blower space 3 and is discharged from the second vent 8. Thus, the quantity of flow of the air discharged from the second vent 8 increases by the quantity of flow of the air drawn from the outside.

Patent Document 1: International Publication No. 2009/148008

BRIEF SUMMARY OF THE DISCLOSURE

The piezoelectric blower 900 in Patent Document 1 needs to be miniaturized and have a further increased discharge flow quantity with miniaturization of electronic devices for incorporating the piezoelectric blower.

As described above, the electrode on the second principal surface 20B of the piezoelectric element 20 is electrically connected to the electrode terminal 82 with the lead wire 79. Thus, the connection between the electrode on the second principal surface 20B of the piezoelectric element 20 and the lead wire 79 is significantly weaker than that between the electrode on the first principal surface 20A of the piezoelectric element 20 and the intermediate plate 22.

Accordingly, the piezoelectric blower 900 has a problem in that if an impact, such as a drop impact occurring when the electronic device incorporating the piezoelectric blower 900 falls to the ground, is given to the connection portion of the electrode on the second principal surface 20B and the lead wire 79, the lead wire 79 is easily separated from the electrode on the second principal surface 20B of the piezoelectric element 20.

Consequently, it is an object of the present disclosure to provide a piezoelectric blower in which the discharge flow quantity is larger than that in the related art and the connection between an electrode on each of both principal surfaces of a piezoelectric element and a wire connected to the electrode is stronger than that in the related art.

A piezoelectric blower according to the present disclosure has a configuration below to solve the problem.

(1) The piezoelectric blower includes a piezoelectric element having a first principal surface and a second principal surface opposed to the first principal surface and including an electrode disposed on each of the first and second principal surfaces, a first vibrating portion bonded to the first principal surface of the piezoelectric element, the first vibrating portion being configured to bend and vibrate by the piezoelectric element, a first casing bonded to a surface of the first vibrating portion opposite to the piezoelectric element, the first casing and the first vibrating portion defining a first blower space, the first casing having a first cavity communicating between the inside and outside of the first blower space, a second vibrating portion including an intermediate portion bonded to the second principal surface of the piezoelectric element and a flat plate portion connected to the intermediate portion, the second vibrating portion being configured to bend and vibrate by the piezoelectric element, and a second casing bonded to a surface of the flat plate portion opposite to the piezoelectric element, the second casing and the second vibrating portion defining a second blower space, the second casing having a second cavity communicating between the inside and outside of the second blower space.

The first vibrating portion and the intermediate portion are conductive, and a distance from a neutral plane of the piezoelectric element in a thickness direction of the piezoelectric element to a surface of the first vibrating portion facing the piezoelectric element is different from a distance from the neutral plane to a surface of the flat plate portion facing the piezoelectric element.

In this configuration, the first casing, first vibrating portion, piezoelectric element, second vibrating portion, and second casing are laminated in this order and form the blower main body. The neutral plane in the piezoelectric element in the thickness direction is a plane that is perpendicular to the thickness direction of the piezoelectric element and that extends along the center of the piezoelectric element in the thickness direction.

In this configuration, when an alternating drive voltage is applied to the piezoelectric element, the piezoelectric element expands and contracts. Because the distance from the neutral plane to the surface facing the piezoelectric element of the first vibrating portion differs from the distance from the neutral plane to the surface facing the piezoelectric element of the flat plate portion, the blower main body is asymmetric with respect to the neutral plane. Thus the flexibility of the first vibrating portion due to the expansion and contraction of the piezoelectric element and the flexibility of the second vibrating portion due to the expansion and contraction of the piezoelectric element are different.

Accordingly, in this configuration, the two blower spaces are disposed on both sides of the piezoelectric element, respectively, and both the first and second vibrating portions flexurally vibrate by the expansion and contraction of the piezoelectric element without cancelling out their vibrations. That is, the volumes of both the first and second blower spaces change due to the expansion and contraction of the piezoelectric element. Thus, the sum of the volume change amount of the first blower space and that of the second blower space is larger than the volume change amount of only one blower space in the related art. Accordingly, in this configuration, the discharge flow quantity in the piezoelectric blower is larger than that in the related art.

In this configuration, the first principal surface of the piezoelectric element is in contact with the conductive first vibrating portion, and the second principal surface is in contact with the conductive intermediate portion in the second vibrating portion. That is, the contact between the electrode on each of both the principal surfaces of the piezoelectric element and the wire connected to the electrode is surface contact. Thus, the connection between the electrode on each of both the principal surfaces of the piezoelectric element and the wire connected to the electrode is stronger than that in the related art.

Accordingly, with this configuration, the discharge flow quantity can be larger than that in the related art, and the connection between the electrode on each of both the principal surfaces of the piezoelectric element and the wire connected to the electrode can be stronger than that in the related art.

(2) The intermediate portion may preferably project from the flat plate portion toward the piezoelectric element.

In this configuration, the distance from the neutral plane to the surface facing the piezoelectric element of the flat plate portion is longer than the distance from the neutral plane to the surface facing the piezoelectric element of the first vibrating portion.

(3) The intermediate portion may preferably have a diameter smaller than a diameter of the second blower space.

The boundary between the portion bonded to the second casing and the portion facing the second blower space in the second vibrating portion acts as a fulcrum of bending vibration of the second vibrating portion.

In this configuration, because the diameter of the intermediate portion is smaller than the diameter of the second blower space, the flexibility of the second vibrating portion due to the expansion and contraction of the piezoelectric element does not decrease. Thus, the flexibility of the first vibrating portion due to the expansion and contraction of the piezoelectric element and the flexibility of the second vibrating portion due to the expansion and contraction of the piezoelectric element are different. That is, the volumes of both the first and second blower spaces change due to the expansion and contraction of the piezoelectric element. Thus, the sum of the volume change amount of the first blower space and that of the second blower space is larger than the volume change amount of only one blower space in the related art.

Accordingly, with this configuration, the discharge flow quantity can be larger than that in the related art, and the connection between the electrode on each of both the principal surfaces of the piezoelectric element and the wire connected to the electrode can be stronger than that in the related art.

(4) The intermediate portion and the flat plate portion in the second vibrating portion may preferably be integral with each other.

In this configuration, the strength of bonding between the intermediate portion and the flat plate portion is larger than that when the intermediate portion and the flat plate portion are disposed as separated components. Thus, this configuration can prevent a decrease in characteristics of the piezoelectric blower caused by misalignment between the intermediate portion and the flat plate portion, for example. Accordingly, this configuration can achieve improved reliability of the piezoelectric blower.

According to the present disclosure, the discharge flow quantity can be larger than that in the related art, and the connection between the electrode on each of both the principal surfaces of the piezoelectric element and the wire connected to the electrode can be stronger than that in the related art.

DETAILED DESCRIPTION OF THE DISCLOSURE

Embodiments of Present Disclosure

A piezoelectric blower 100 according to an embodiment of the present disclosure is described below.

Figure 1:
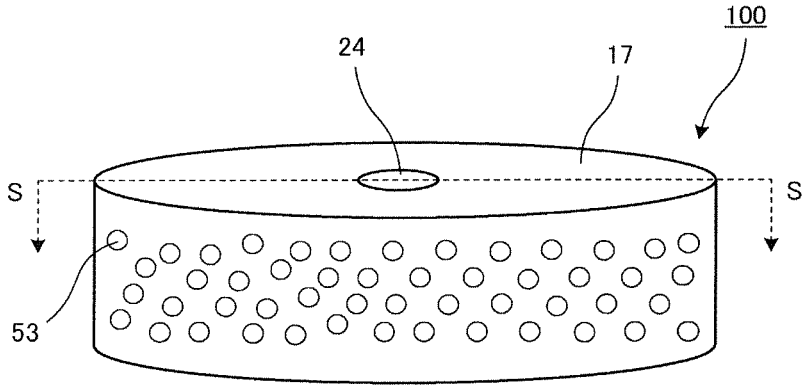
FIG. 1 is an external perspective view of a piezoelectric blower 100 according to an embodiment of the present disclosure.
Figure 2:
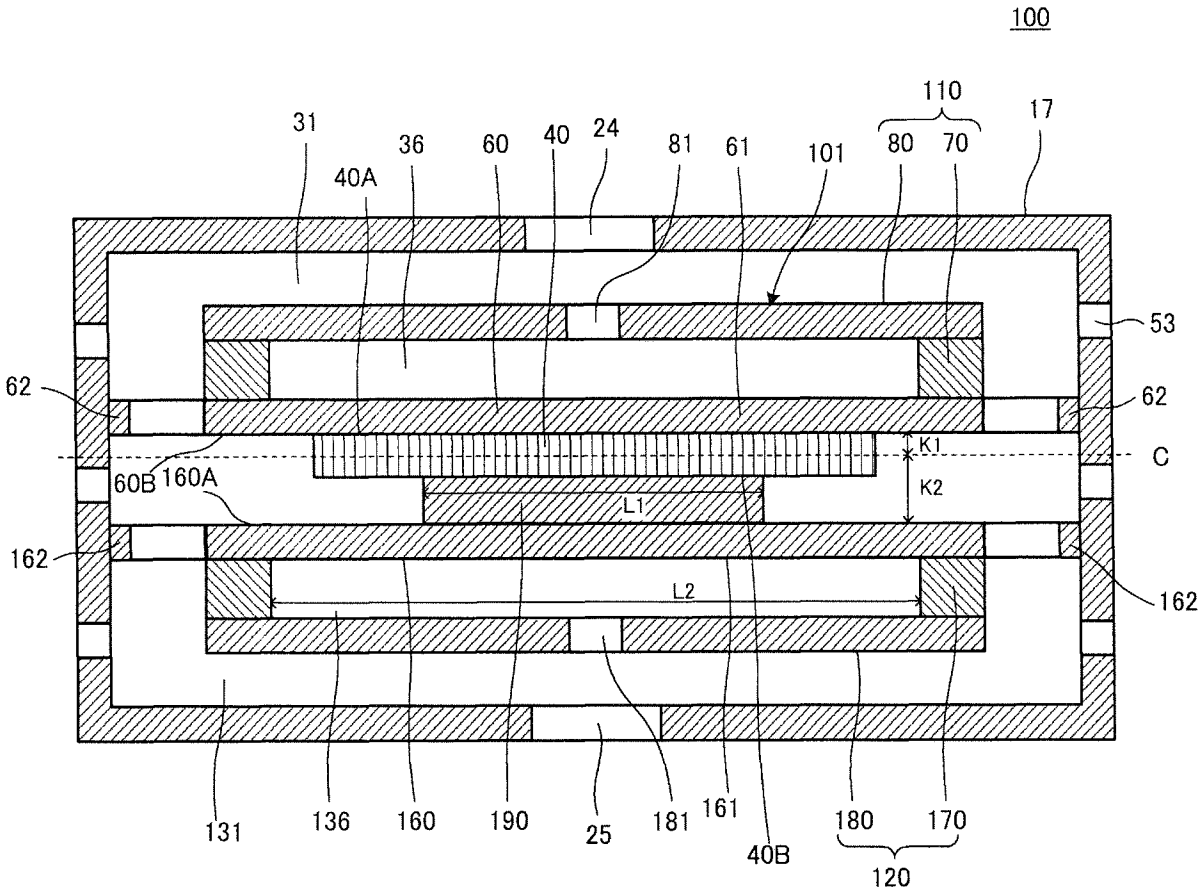
FIG. 2 is a cross-sectional view of the piezoelectric blower 100 illustrated in FIG. 1 taken along line S-S.
Figure 3:
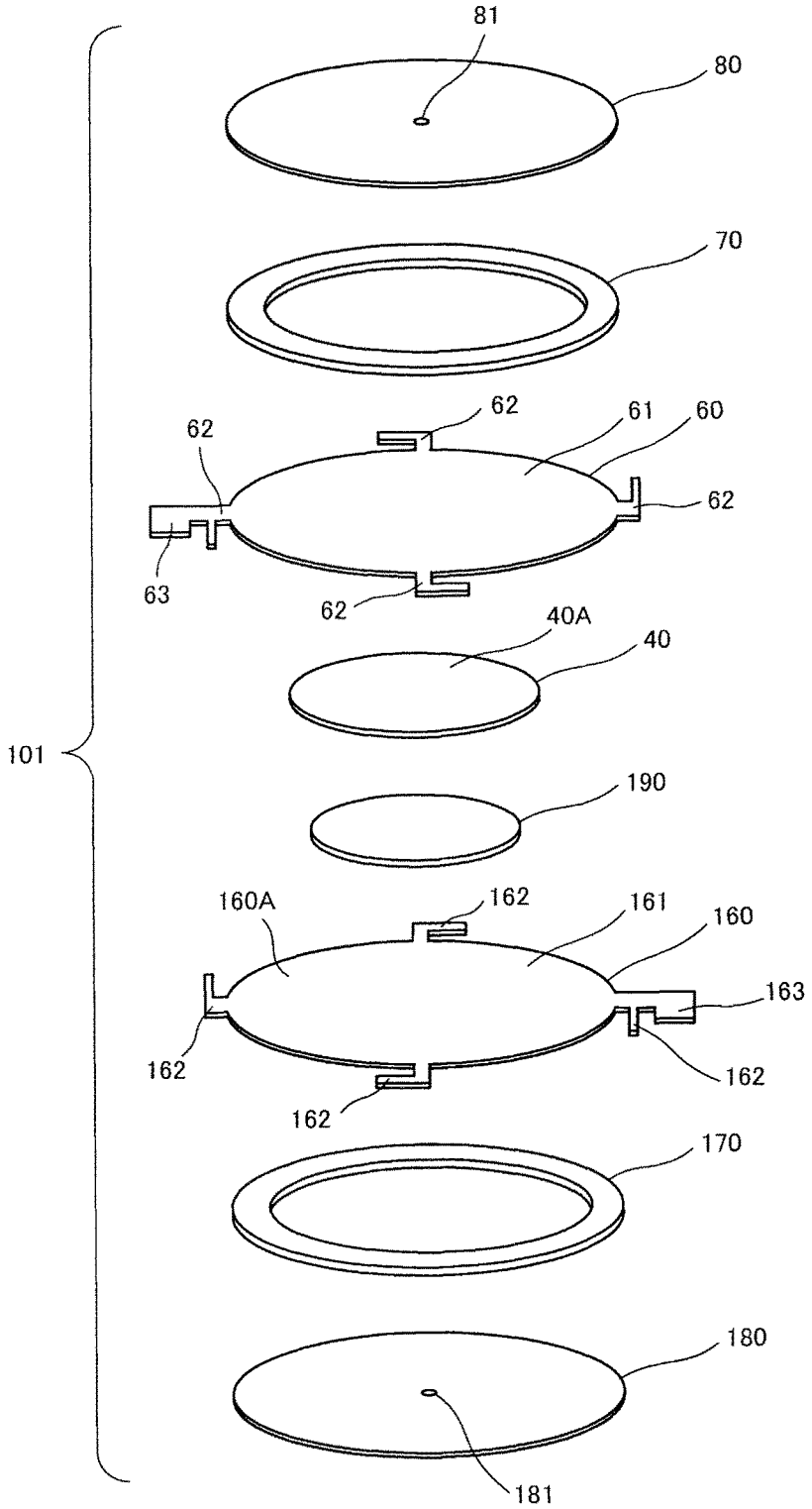
FIG. 3 is an exploded perspective view of a blower main body 101 included in the piezoelectric blower 100 illustrated in FIG. 1.

FIG. 1 is an external perspective view of the piezoelectric blower 100 according to the embodiment of the present disclosure. FIG. 2 is a cross-sectional view of the piezoelectric blower 100 illustrated in FIG. 1 taken along line S-S. FIG. 3 is an exploded perspective view of a blower main body 101 included in the piezoelectric blower 100 illustrated in FIG. 1.

The piezoelectric blower 100 includes an outer casing 17 and the blower main body 101.

The outer casing 17 is cylindrical. The outer casing 17 has a plurality of intakes 53 in its side surface. The intakes 53 allow the air outside the outer casing 17 to be sucked into the outer casing 17 therethrough. The outer casing 17 has an exit 24 in its upper surface. The exit 24 allows the air inside the outer casing 17 to be ejected therethrough. The outer casing 17 has an exit 25 in its bottom surface. The exit 25 allows the air inside the outer casing 17 to be ejected therethrough. The outer casing 17 may be made of resin. The outer casing 17 houses the blower main body 101.

The outer casing 17 used in the present embodiment is cylindrical. Other forms may also be used. The outer casing 17 may have a rectangular parallelepiped shape. The piezoelectric blower 100 may also be used in a state where the outer casing 17 is removed and only the blower main body 101 is disposed.

The blower main body 101 includes a top plate 80, a side plate 70, a first vibrating plate 60, a piezoelectric element 40, an intermediate plate 190, a second vibrating plate 160, a side plate 170, and a bottom plate 180 disposed in this order from above and has a structure in which they are laminated in sequence. The top plate 80 and the side plate 70 form a first casing 110. The side plate 170 and the bottom plate 180 form a second casing 120. The top plate 80, the side plate 70, and the first vibrating plate 60 define a columnar first blower space 36. The second vibrating plate 160, the side plate 170, and the bottom plate 180 define a columnar second blower space 136.

The first vibrating plate 60 corresponds to "first vibrating portion" in the present disclosure. The intermediate plate 190 and the second vibrating plate 160 form "second vibrating portion" in the present disclosure. The intermediate plate 190 corresponds to "intermediate portion" in the present disclosure. The second vibrating plate 160 corresponds to "flat plate portion" in the present disclosure.

The top plate 80 has a disc shape. The top plate 80 has a first cavity 81 communicating between the inside and outside of the first blower space 36. The first cavity 81 is disposed in a location opposed to the exit 24 in the outer casing 17. The top plate 80 is bonded to an upper surface of the side plate 70.

The side plate 70 has an annular shape. The side plate 70 is bonded to an upper surface of the first vibrating plate 60. Thus, the thickness of the side plate 70 is the height of the first blower space 36.

The first vibrating plate 60 has a disc shape. The first vibrating plate 60 includes a disc portion 61, key-shaped supporting portions 62 horizontally projecting from the peripheral edge of the outer region of the disc portion 61 in a radial direction, and an outer terminal 63 for connecting to an external circuit.

The piezoelectric element 40 has a disc shape and may be made of a PZT-based ceramic material. The piezoelectric element 40 has first and second principal surfaces 40A and 40B, each of which an electrode for driving the piezoelectric element 40 is disposed. The first principal surface 40A of the piezoelectric element 40 is bonded to the first vibrating plate 60. The second principal surface 40B of the piezoelectric element 40 is bonded to the intermediate plate 190.

The intermediate plate 190 has a disc shape. The intermediate plate 190 is bonded to an upper surface 160A of the second vibrating plate 160. The diameter L1 of the intermediate plate 190 is smaller than the diameter L2 of the second blower space 136.

The second vibrating plate 160 has a disc shape. The second vibrating plate 160 includes a disc portion 161, key-shaped supporting portions 162 horizontally projecting from the peripheral edge of the outer region of the disc portion 161 in a radial direction, and an outer terminal 163 for connecting to an external circuit. The second vibrating plate 160 is bonded to an upper surface of the side plate 170.

The side plate 170 has an annular shape. The side plate 170 is bonded to an upper surface of the bottom plate 180. Thus, the thickness of the side plate 170 is the height of the second blower space 136.

The bottom plate 180 has a disc shape. The bottom plate 180 has a second cavity 181 communicating between the inside and outside of the second blower space 136. The second cavity 181 is disposed in a location opposed to the exit 25 in the outer casing 17.

Example materials and dimensions of the components included in the blower main body 101 in the present embodiment are described below. A metal material may be one example of the material of each of the top plate 80, side plate 70, first vibrating plate 60, intermediate plate 190, second vibrating plate 160, side plate 170, and bottom plate 180. In the present embodiment, SUS430 is used as the material of each of the top plate 80, side plate 70, first vibrating plate 60, second vibrating plate 160, side plate 170, and bottom plate 180, and 42Ni is used as the material of the intermediate plate 190.

The dimensions of the top plate 80 are 17 mm in outside diameter, 1 mm in inside diameter, and 0.5 mm in thickness. The dimensions of the side plate 70 are 17 mm in outside diameter, 14 mm in inside diameter, and 0.3 mm in thickness. The dimensions of the first vibrating plate 60 are 17 mm in diameter and 0.4 mm in thickness. The dimensions of the piezoelectric element 40 are 11 mm in diameter and 0.1 mm in thickness. The dimensions of the intermediate plate 190 are 4 mm in diameter and 0.2 mm in thickness. The dimensions of the second vibrating plate 160 are 17 mm in diameter and 0.4 mm in thickness. The dimensions of the side plate 170 are 17 mm in outside diameter, 14 mm in inside diameter, and 0.3 mm in thickness. The dimensions of the bottom plate 180 are 17 mm in outside diameter, 1 mm in inside diameter, and 0.5 mm in thickness.

In the above-described configuration, the blower main body 101 is elastically supported on the outer casing 17 by the four supporting portions 62 in the first vibrating plate 60 and the four supporting portions 162 in the second vibrating plate 160. As illustrated in FIG. 2, an airway 31 is disposed between the first casing, which is the bonded structure of the top plate 80 and the side plate 70, and the outer casing 17. An airway 131 is disposed between the second casing, which is the bonded structure of the bottom plate 180 and the side plate 170, and the outer casing 17.

As illustrated in FIG. 2, the distance K2 from a neutral plane C in the piezoelectric element 40 in the thickness direction to the upper surface 160A, which is near the piezoelectric element 40, of the second vibrating plate 160 is longer than the distance K1 from the neutral plane C in the piezoelectric element 40 in the thickness direction to a surface 60B of the first vibrating plate 60, the surface 60B facing the piezoelectric element 40, by the thickness of the intermediate plate 190. The neutral plane C in the piezoelectric element 40 in the thickness direction is a plane that is perpendicular to the thickness direction of the piezoelectric element 40 and that extends along the center of the piezoelectric element 40 in the thickness direction.

The piezoelectric element 40 is disposed between the first vibrating plate 60 and the intermediate plate 190, both of which have conductivity. The electrode on the first principal surface 40A of the piezoelectric element 40 is bonded to the lower surface 60B, which is opposite to the first blower space 36, of the first vibrating plate 60. The electrode on the second principal surface 40B of the piezoelectric element 40 is bonded to an upper surface 190A of the intermediate plate 190, the upper surface 190A facing the first blower space 36. Thus, the piezoelectric element 40 expands and contracts in accordance with an alternating drive voltage applied across both the electrodes from the outer terminals 63 and 163.

The piezoelectric blower 100 is arranged such that the exit 24 faces a first cooling target (heat source), such as a central processing unit (CPU), and the exit 25 faces a second cooling target. The piezoelectric blower 100 cools both of the first and second cooling targets at the same time by air flowing out through the exits 24 and 25.

Air streams occurring when the piezoelectric blower 100 is operating are described below.

Figure 4A:
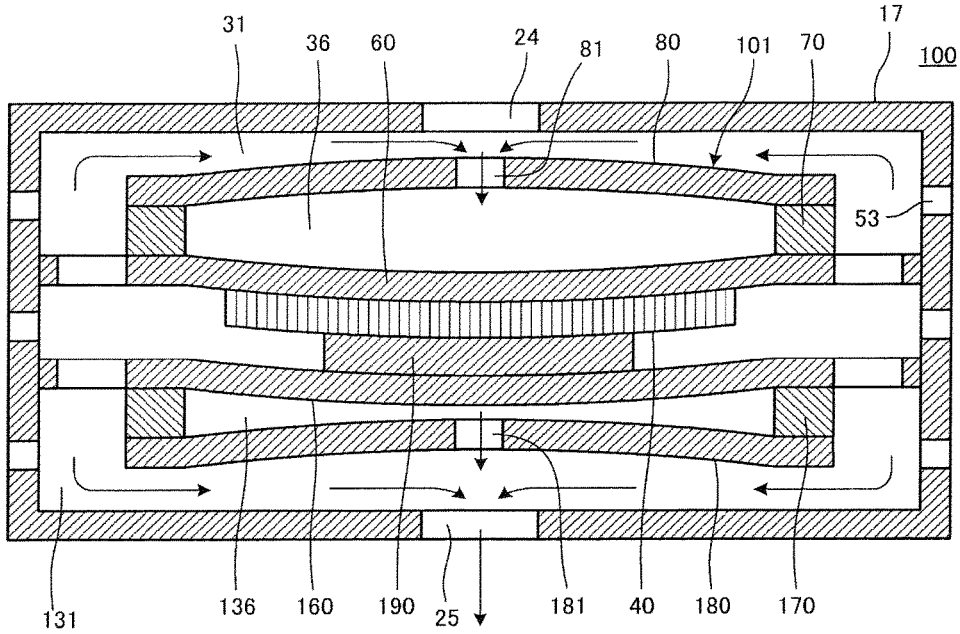
FIGS. 4A and 4B are cross-sectional views of the piezoelectric blower 100 illustrated in FIG. 1 taken along the line S-S when it is driven so as to resonate at a frequency in first-order vibration mode (fundamental wave).
Figure 4B:
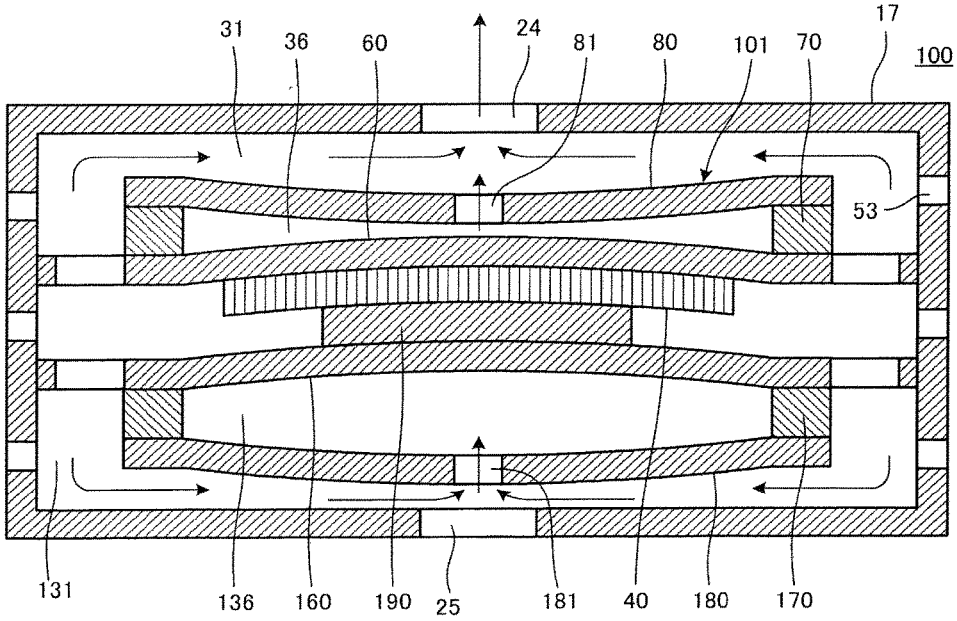

FIGS. 4A and 4B are cross-sectional views of the piezoelectric blower 100 illustrated in FIG. 1 taken along the line S-S when the piezoelectric blower 100 is driven so as to resonate at a frequency in first-order vibration mode (fundamental wave) of the blower main body. The arrows in the drawings denote the streams of air.

In the state illustrated in FIG. 3, when an alternating drive voltage corresponding to a frequency in first-order vibration mode (fundamental wave) of the blower main body is applied to the piezoelectric element 40 from the outer terminals 63 and 163, each of the first and second vibrating plates 60 and 160 bends and vibrates concentrically.

At the same time, due to the pressure changes in the first blower space 36 resulting from the bending vibration of the first vibrating plate 60, the top plate 80 bends and vibrates concentrically together with the bending vibration of the first vibrating plate 60 (in the present embodiment, such that its vibration phase lags by 180 degrees). Thus, as illustrated in FIGS. 4A and 4B, the first vibrating plate 60 and the top plate 80 bend and deform, and the volume of the first blower space 36 changes periodically.

At the same time, due to the pressure changes in the second blower space 136 resulting from the bending vibration of the second vibrating plate 160, the bottom plate 180 bends and vibrates concentrically together with the bending vibration of the second vibrating plate 160 (in the present embodiment, such that its vibration phase lags by 180 degrees). Thus, as illustrated in FIGS. 4A and 4B, the second vibrating plate 160 and the bottom plate 180 bend and deform, and the volume of the second blower space 136 changes periodically.

First, the air streams in the first blower space 36 are described.

As illustrated in FIG. 4A, when an alternating drive voltage is applied to the piezoelectric element 40 and the first vibrating plate 60 bends toward the piezoelectric element 40, the volume of the first blower space 36 increases. With this, air outside the piezoelectric blower 100 is sucked into the first blower space 36 through the intakes 53, airway 31, and first cavity 81. At this time, although no air flows out of the first blower space 36, there is inertial force of air streams from the exit 24 to the outside of the piezoelectric blower 100.

As illustrated in FIG. 4B, when an alternating drive voltage is applied to the piezoelectric element 40 and the first vibrating plate 60 bends toward the first blower space 36, the volume of the first blower space 36 decreases. With this, the air inside the first blower space 36 is discharged through the first cavity 81, passes through the airway 31, and is ejected through the exit 24.

At this time, due to the air discharged from the first blower space 36, the air outside the piezoelectric blower 100 is drawn through the intakes 53 and the airway 31 and then ejected through the exit 24. Thus the quantity of flow of air ejected through the exit 24 increases by the quantity of flow of air drawn from the outside.

Next, the air streams in the second blower space 136 are described.

As illustrated in FIG. 4B, when an alternating drive voltage is applied to the piezoelectric element 40 and the intermediate plate 190 and the second vibrating plate 160 bend toward the piezoelectric element 40, the volume of the second blower space 136 increases. With this, air outside the piezoelectric blower 100 is sucked into the second blower space 136 through the intakes 53, airway 131, and second cavity 181. At this time, although no air flows out of the second blower space 136, there is inertial force of air streams from the exit 25 to the outside of the piezoelectric blower 100.

As illustrated in FIG. 4A, when an alternating drive voltage is applied to the piezoelectric element 40 and the intermediate plate 190 and the second vibrating plate 160 bend toward the second blower space 136, the volume of the second blower space 136 decreases. With this, the air inside the second blower space 136 is discharged through the second cavity 181, passes through the airway 131, and is ejected through the exit 25.

At this time, due to the air discharged from the second blower space 136, the air outside the piezoelectric blower 100 is drawn through the intakes 53 and the airway 131 and then ejected through the exit 25. Thus the quantity of flow of air ejected through the exit 25 increases by the quantity of flow of air drawn from the outside.

As illustrated in FIG. 2, the distance K2 from the neutral plane C in the piezoelectric element 40 in the thickness direction to the upper surface 160A, which is near the piezoelectric element 40, of the second vibrating plate 160, is longer than the distance K1 from the neutral plane C in the piezoelectric element 40 in the thickness direction to the surface 60B, which is near the piezoelectric element 40, of the first vibrating plate 60, by the thickness of the intermediate plate 190. The neutral plane C in the piezoelectric element 40 in the thickness direction is a plane that is perpendicular to the thickness direction of the piezoelectric element 40 and that extends along the center of the piezoelectric element 40 in the thickness direction. Thus the blower main body 101 is asymmetric with respect to the neutral plane C.

Here, a force caused by the expansion and contraction of the piezoelectric element 40 is expressed as F. The flexibility of the first vibrating plate 60 is expressed as moment M1. The flexibility of the second vibrating plate 160 is expressed as moment M2.

When the piezoelectric element 40 contracts, the moment M1=F K1 in the direction in which the first vibrating plate 60 flexes toward the first blower space 36 occurs in the first vibrating plate 60, and the moment M2=F K2 in the direction in which the second vibrating plate 160 flexes toward the second blower space 136 occurs in the second vibrating plate 160. The moments M1 and M2 are in the opposite directions. The first vibrating plate 60 and the second vibrating plate 160 are bonded to the piezoelectric element 40 and the intermediate plate 190, respectively. Thus, when the piezoelectric element 40 contracts, the moment "M2−M1" in the direction in which both the vibrating plates 60 and 160 flex toward the second blower space 136 occurs in both the vibrating plates 60 and 160.

Here, when M1 and M2 are near values, the moments M1 and M2 are cancelled out, and the moment "M2−M1" occurring in both the vibrating plates 60 and 160 is small. Thus, large flexural deformation does not occur in both the vibrating plates 60 and 160.

As illustrated in FIG. 2, however, when K2 is larger than K1, the moment "M2−M1" in the direction in which both the vibrating plates 60 and 160 flex toward the second blower space 136 is large. Thus, large flexural deformation toward the second blower space 136 occurs in both the vibrating plates 60 and 160.

In contrast, when the piezoelectric element 40 expands, the direction of the moments M1 and M2 is opposite to the direction described above. That is, when the piezoelectric element 40 expands, the moment "M2−M1" in the direction in which both the vibrating plates 60 and 160 flex toward the first blower space 36 occurs in both the vibrating plates 60 and 160.

When M1 and M2 are near values, the moments M1 and M2 are cancelled out, and the moment "M2−M1" occurring in both the vibrating plates 60 and 160 is small. Thus, large flexural deformation does not occur in both the vibrating plates 60 and 160.

As illustrated in FIG. 2, however, when K2 is larger than K1, the moment "M2−M1" in the direction in which both the vibrating plates 60 and 160 flex toward the first blower space 36 is large. Thus, large flexural deformation toward the first blower space 36 occurs in both the vibrating plates 60 and 160.

In this manner, the expansion and contraction of the piezoelectric element 40 causes both the first and second vibrating plates 60 and 160 to flexurally vibrate without cancelling out their vibrations produced by the piezoelectric element 40. That is, the expansion and contraction of the piezoelectric element 40 changes the volume of each of the first and second blower spaces 36 and 136. Thus, the sum of the volume change amount of the first blower space 36 and that of the second blower space 136 is larger than the volume change amount of only one blower space in the related art. Accordingly, the discharge flow quantity in the blower main body 101 is larger than that in the related art.

In the blower main body 101, the first principal surface 40A of the piezoelectric element 40 is in contact with the conductive first vibrating plate 60, and the second principal surface 40B is in contact with the conductive intermediate plate 190. That is, the contact between the electrode on each of both the principal surfaces 40A and 40B of the piezoelectric element 40 and the wire connected to the electrode is surface contact. Thus, in the blower main body 101, the connection between the electrode on each of both the principal surfaces 40A and 40B of the piezoelectric element 40 and the wire connected to the electrode is stronger than that in the related art.

Accordingly, the piezoelectric blower 100 in the present embodiment can have a discharge flow quantity larger than that in the related art and can have connection with the electrode on each of both the principal surfaces 40A and 40B of the piezoelectric element 40 stronger than that in the related art.

The comparison between the discharge flow quantity in the blower main body 101 illustrated in FIGS. 2 and 3 and the discharge flow quantity in a blower main body 501 in a piezoelectric blower 500 according to a first comparative example to the embodiment in the present disclosure is described below.

Figure 5:
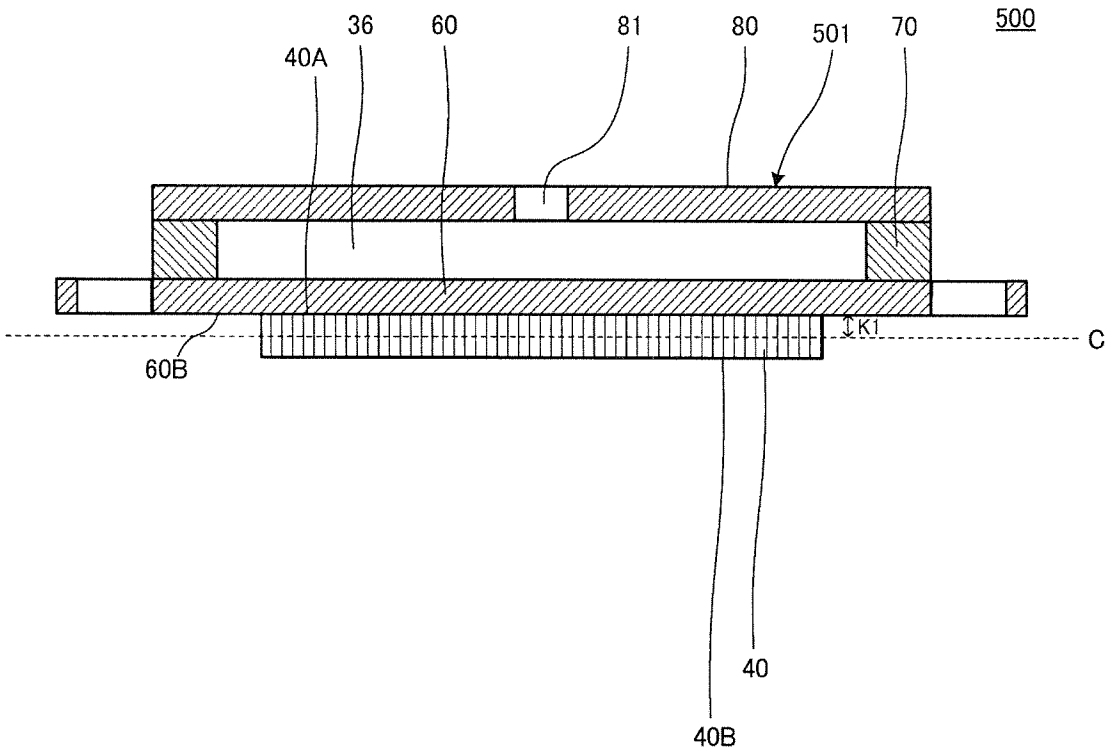
FIG. 5 is a cross-sectional view of a piezoelectric blower 500 according to a first comparative example to the embodiment of the present disclosure.

FIG. 5 is a cross-sectional view of the piezoelectric blower 500 according to the first comparative example to the embodiment in the present disclosure. The piezoelectric blower 500 differs from the piezoelectric blower 100 in that the intermediate plate 190, second vibrating plate 160, side plate 170, bottom plate 180, and outer casing 17 are not included. Specifically, the blower main body 501 in the piezoelectric blower 500 includes the top plate 80, side plate 70, first vibrating plate 60, and piezoelectric element 40 in this order from above and has a structure in which they are laminated in sequence. The other configuration of the blower main body 501 is the same as that of the blower main body 101 and is not described here.

The following illustrates the results obtained from the simulated calculation of the displacement amount of the center of each of the blower main bodies 101 and 501 and the volume change amount of the blower space when a sinusoidal alternating drive voltage of 15 Vpp corresponding to the frequency in first-order vibration mode (fundamental wave) of the blower main bodies 101 and 501 is applied to the blower main bodies 101 and 501.

The discharge flow quantity in the blower main body 101 is the sum of the quantity of flow of air discharged through the first cavity 81 and that through the second cavity 181. The discharge flow quantity in the blower main body 501 is the quantity of flow of air discharged through the first cavity 81. In the experiment, for the blower main body 101 with the outer casing 17 being detached, the displacement of the center of the first vibrating plate 60 and the sum of the volume change amount of the first blower space 36 and that of the second blower space 136 were calculated.

The experiment reveals that the displacement of the center of the first vibrating plate 60 in the blower main body 501 is 5.8 m and that in the blower main body 101 is 3.3 m. The experiment reveals that the volume change amount of the first blower space 36 in the blower main body 501 is 1.19 L/min and the sum of the volume change amount of the first blower space 36 and that of the second blower space 136 in the blower main body 101 is 1.61 L/min.

It is expected from the above results that, because the discharge flow quantity in the blower main body is proportional to the volume change amount of the blower space, the discharge flow quantity in the blower main body 101 is significantly larger than the discharge flow quantity in the blower main body 501. The reasons for the above results may be that the blower main body 101 includes the two blower spaces 36 and 136, the flexibility of the first vibrating plate 60 and that of the second vibrating plate 160 are different because the distances K1 and K2 are different as described above, and both the first and second vibrating plates 60 and 160 flexurally vibrate without cancelling out their vibrations produced by the piezoelectric element 40.

Accordingly, the blower main body 101 in the present embodiment can have a discharge flow quantity larger than that in a blower main body in the related art.

Next, the comparison between the discharge flow quantity in the blower main body 101 illustrated in FIGS. 2 and 3 and the discharge flow quantity in a blower main body 601 in a piezoelectric blower 600 according to a second comparative example to the embodiment in the present disclosure is described below.

Figure 6:
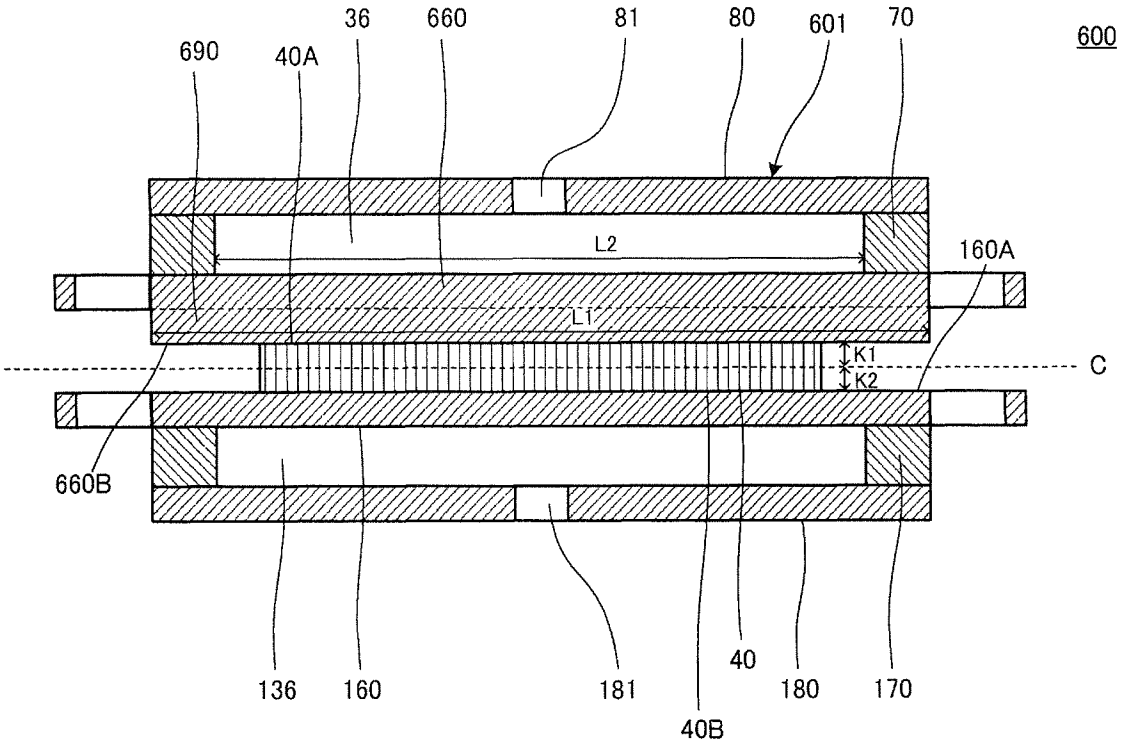
FIG. 6 is a cross-sectional view of a piezoelectric blower 600 according to a second comparative example to the embodiment of the present disclosure.

FIG. 6 is a cross-sectional view of the piezoelectric blower 600 according to the second comparative example to the embodiment in the present disclosure. The piezoelectric blower 600 differs from the piezoelectric blower 100 in that the intermediate plate 190 and outer casing 17 are not included and a first vibrating plate 660 is included.

Specifically, the blower main body 601 in the piezoelectric blower 600 includes the top plate 80, side plate 70, first vibrating plate 660, piezoelectric element 40, second vibrating plate 160, side plate 170, and bottom plate 180 in this order from above and has a structure in which they are laminated in sequence. The first vibrating plate 660 includes an intermediate portion 690. The diameter L1 of the intermediate portion 690 is larger than the diameter L2 of the first blower space 36. The first vibrating plate 660 is thicker than the second vibrating plate 160 by the thickness of the intermediate portion 690. Thus, the distance K1 from the neutral plane C in the piezoelectric element 40 in the thickness direction to a surface 660B of the first vibrating plate 660, the surface 660B facing the piezoelectric element 40, is equal to the distance K2 from the neutral plane C in the piezoelectric element 40 in the thickness direction to the surface 160A, which is near the piezoelectric element 40, of the second vibrating plate 160. The other configuration of the blower main body 601 is the same as that of the blower main body 101 and is not described here.

In the second variation, the dimensions of the first vibrating plate 660 are 17 mm in diameter and 0.4 mm in thickness. The dimensions of the second vibrating plate 160 are 17 mm in diameter and 0.2 mm in thickness. The materials and dimensions of the other components are the same as those in the blower main body 101.

Below are results obtained from calculation of simulation of the amount of displacement of the center of each of the blower main bodies 101 and 601 and the volume change amount of the blower space when a sinusoidal alternating drive voltage of 15 Vpp corresponding to the frequency in first-order vibration mode (fundamental wave) of the blower main bodies 101 and 601 is applied to the blower main bodies 101 and 601.

The discharge flow quantity in the blower main body 101 is the sum of the quantity of flow of air discharged through the first cavity 81 and that through the second cavity 181. The discharge flow quantity in the blower main body 601 is the sum of the quantity of flow of air discharged through the first cavity 81 and that through the second cavity 181. In the experiment, for the blower main body 101 with the outer casing 17 being detached, the displacement of the center of the first vibrating plate 60 and the sum of the volume change amount of the first blower space 36 and that of the second blower space 136 were calculated.

The experiment reveals that the displacement of the center of the first vibrating plate 660 in the blower main body 601 is 0.7 m and that of the first vibrating plate 60 in the blower main body 101 is 3.3 m. The experiment reveals that the sum of the volume change amount of the first blower space 36 and that of the second blower space 136 in the blower main body 601 is 0.52 L/min and that in the blower main body 101 is 1.61 L/min.

It is expected from the above results that, because the discharge flow quantity in the blower main body is proportional to the volume change amount of the blower space, the discharge flow quantity in the blower main body 101 is significantly larger than the discharge flow quantity in the blower main body 601.

The reasons for the above results for the blower main body 601 may be that, as illustrated in FIG. 6, the diameter L1 of the intermediate portion 690 is larger than the diameter L2 of the second blower space 136, the distance K1 and the distance K2 are the same, thus the flexibility of the first vibrating plate 660 and that of the second vibrating plate 160 are substantially the same, and the vibration of the first vibrating plate 660 and the vibration of the second vibrating plate 160 are cancelled out.

The reasons for the above results for the blower main body 101 may be that, as illustrated in FIG. 2, the diameter L1 of the intermediate plate 190 is smaller than the diameter L2 of the second blower space 136, the distance K2 is longer than the distance K1, thus the flexibility of the first vibrating plate 60 and that of the second vibrating plate 160 are different, and large flexural deformation caused by the expansion and contraction of the piezoelectric element 40 occurs in both vibrating plates 60 and 160.

Accordingly, the blower main body 101 according to the present embodiment can have a discharge flow quantity larger than that in a blower main body in the related art.

Other Embodiments

Figure 7:
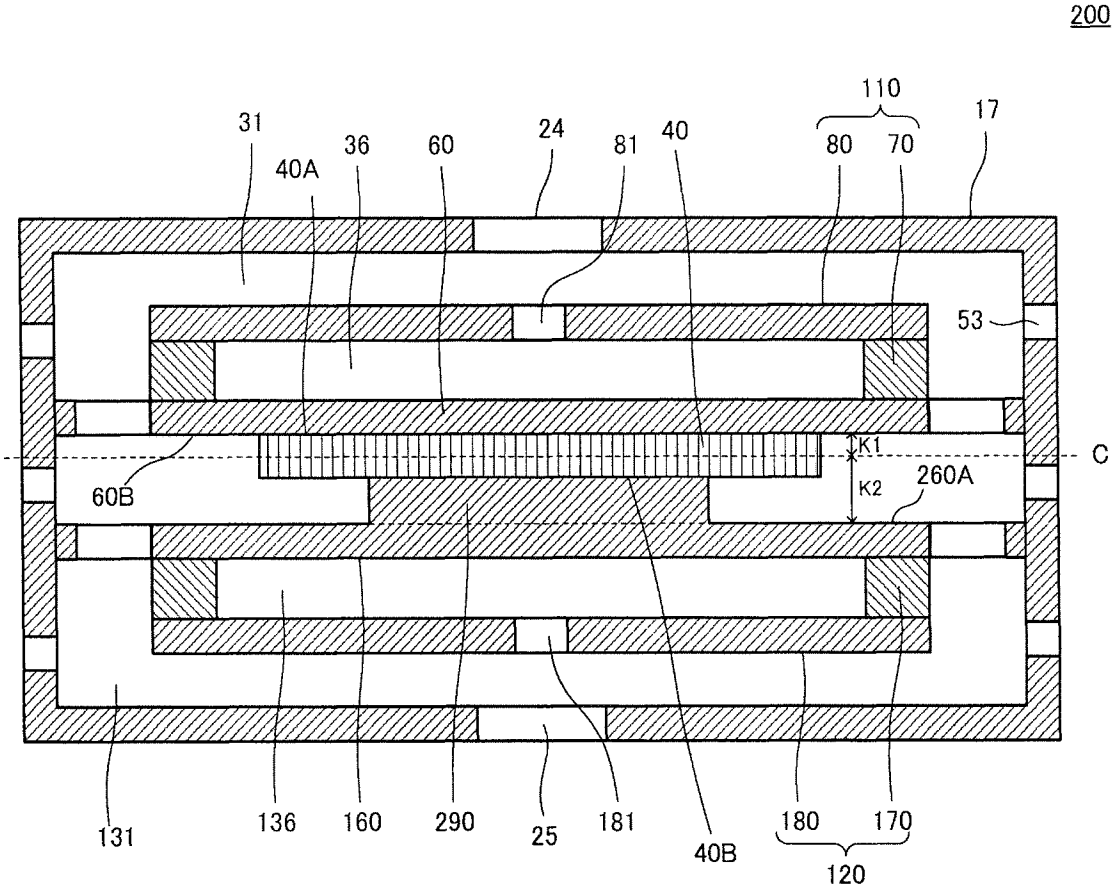
FIG. 7 is a cross-sectional view of a piezoelectric blower 200 according to a first variation of the embodiment of the present disclosure.

In the above embodiment, as illustrated in FIG. 2, the intermediate plate 190 and the second vibrating plate 160 are disposed as separated components. Other forms may also be used. For example, as illustrated in FIG. 7, an intermediate portion 290 and the second vibrating plate 160 may be integrally formed of the same material. In this case, the intermediate portion 290 and the second vibrating plate 160 form "second vibrating portion" in the present disclosure.

In a piezoelectric blower 200 illustrated in FIG. 7, as similar to the above, the distance K2 from the neutral plane C in the piezoelectric element 40 in the thickness direction to a surface 260A of the second vibrating plate 160, the surface 260A facing the piezoelectric element 40, is longer than the distance K1 from the neutral plane C to the surface 60B, which is near the piezoelectric element 40, of the first vibrating plate 60 by the thickness of the intermediate portion 290. Accordingly, the piezoelectric blower 200 can achieve substantially the same advantages as in the piezoelectric blower 100.

Additionally, because the intermediate portion 290 and the second vibrating plate 160 in the piezoelectric blower 200 are integrally formed of the same material, the strength of bonding between the intermediate portion 290 and the second vibrating plate 160 is large. Thus, this configuration can prevent a decrease in characteristics of the piezoelectric blower 200 caused by misalignment between the intermediate portion 290 and the second vibrating plate 160, for example. Accordingly, this configuration can achieve improved reliability of the piezoelectric blower 200.

Figure 8:
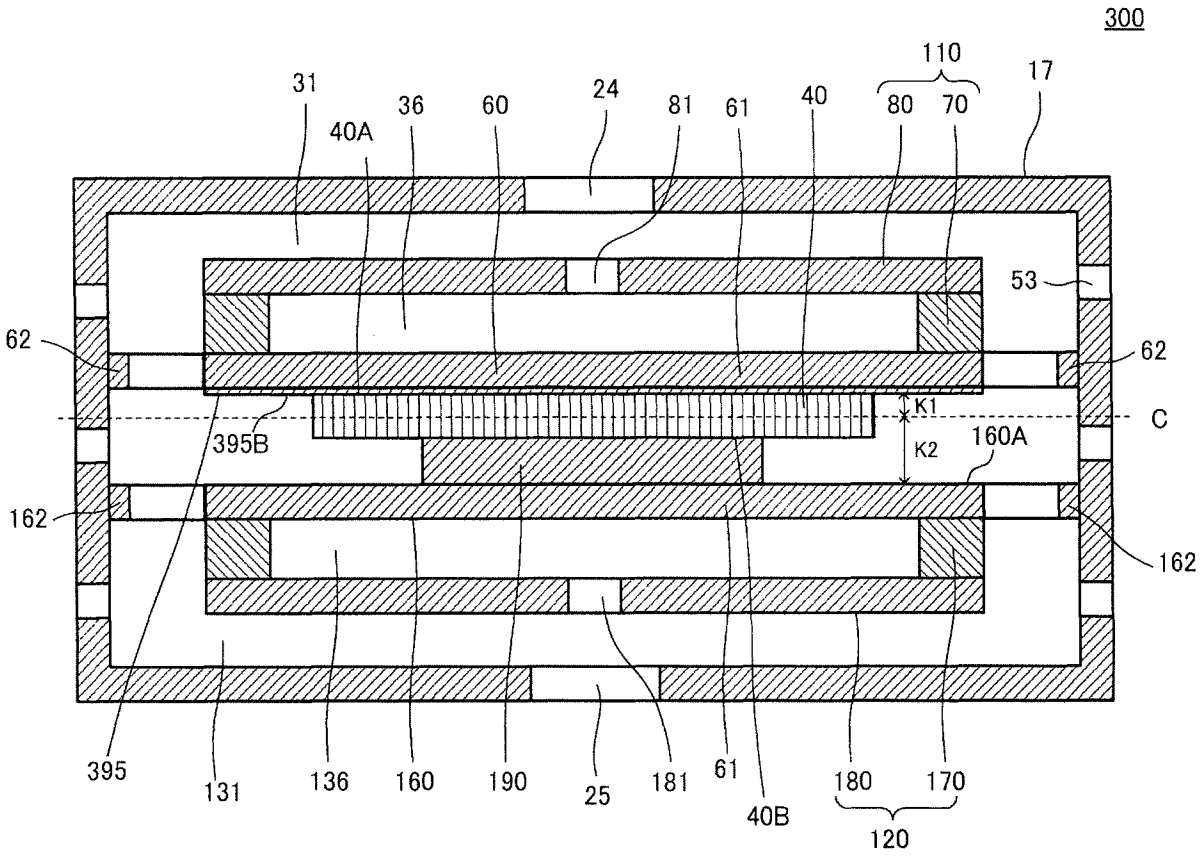
FIG. 8 is a cross-sectional view of a piezoelectric blower 300 according to a second variation of the embodiment of the present disclosure.
Figure 9:
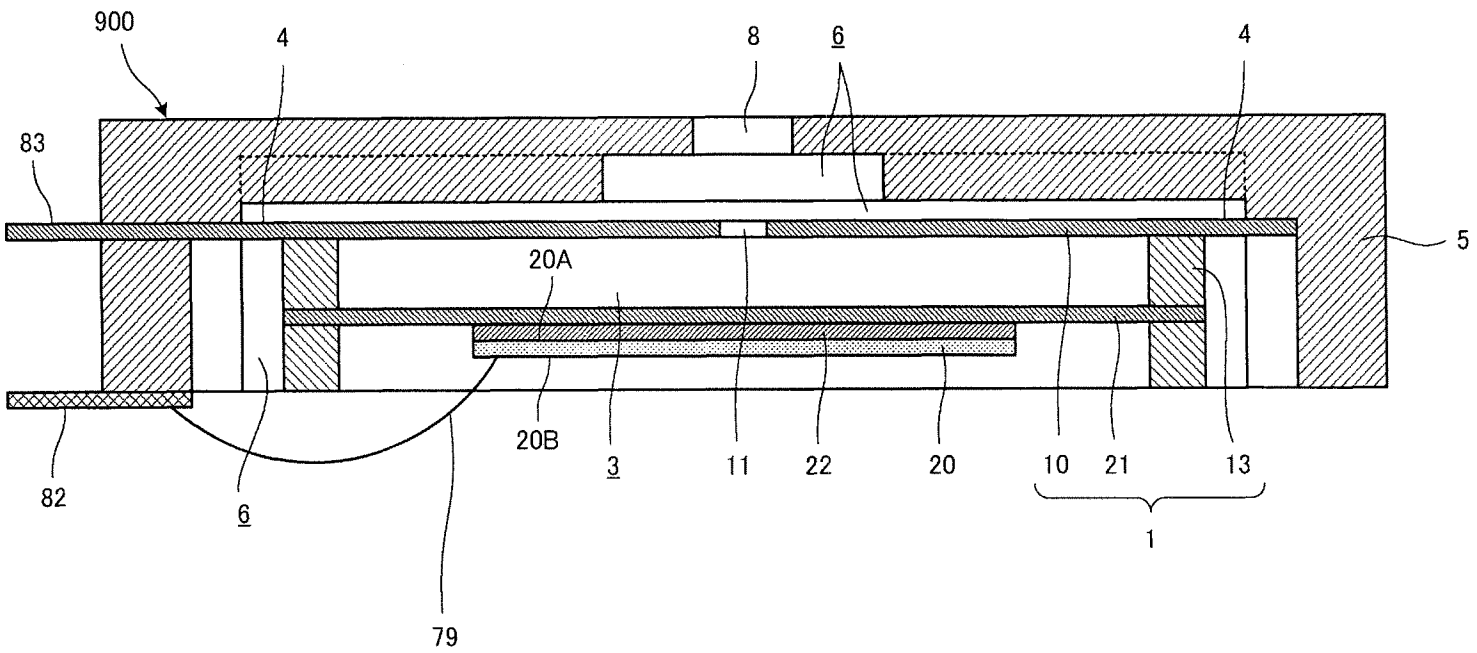
FIG. 9 is a cross-sectional view of a piezoelectric blower 900 according to Patent Document 1.

In the above embodiment, as illustrated in FIG. 2, the piezoelectric element 40 is directly bonded to the first vibrating plate 60. Other forms may also be used. For example, as illustrated in FIG. 8, an intermediate plate 395 may be disposed between the piezoelectric element 40 and the first vibrating plate 60. In this case, the bonded structure of the first vibrating plate 60 and the intermediate plate 395 corresponds to "first vibrating portion" in the present disclosure. In this case, the distance K1 is determined with reference to a surface 395B of the intermediate plate 395, the surface 395B being near the piezoelectric element 40.

In a piezoelectric blower 300 illustrated in FIG. 8, as similar to the above, the distance K2 from the neutral plane C in the piezoelectric element 40 in the thickness direction to the surface 160A, which is near the piezoelectric element 40, of the second vibrating plate 160 is longer than the distance K1 from the neutral plane C to the surface 395B, which is near the piezoelectric element 40, of the intermediate plate 395 by the thickness of the intermediate plate 190. Accordingly, the piezoelectric blower 300 can achieve substantially the same advantages as in the piezoelectric blower 100.

In the above embodiment, air is used as the gas. Other forms may also be used. Gases other than air may also be applicable.

In the above embodiment, the piezoelectric element 40 is made of a PZT-based ceramic material. Other forms may also be used. For example, the piezoelectric element 40 may be made of lead-free piezoelectric ceramic materials, such as a potassium sodium niobate-based ceramic material and an alkali niobate-based ceramic material.

In the above embodiment, the disc-shaped piezoelectric element 40 is used. Other forms may also be used. For example, the piezoelectric element 40 may have a rectangular plate shape, a polygonal plate shape, or an elliptic plate shape.

In the above embodiment, the disc-shaped first and second vibrating plates 60 and 160, the disc-shaped intermediate plate 190, the disc-shaped bottom plate 180, and the disc-shaped top plate 80 are used. Other forms may also be used. For example, these components may have a rectangular plate shape, a polygonal plate shape, or an elliptic plate shape.

In the above embodiment, each piezoelectric blower is driven so as to resonate at the frequency in first-order vibration mode (fundamental wave) of the blower main body. Other forms may also be used. In implementation, it may be driven so as to resonate at a frequency in odd-order vibration mode having a plurality of node at or above the third-order vibration mode.

The above embodiment illustrates an example in which the top plate 80 bends and vibrates concentrically together with the bending vibration of the first vibrating plate 60. Other forms may also be used. In implementation, only the first vibrating plate 60 may bend and vibrate, and the top plate 80 may not bend or vibrate together with the bending vibration of the first vibrating plate 60.

The above embodiment illustrates an example in which the bottom plate 180 bends and vibrates concentrically together with the bending vibration of the second vibrating plate 160. Other forms may also be used. In implementation, only the second vibrating plate 160 may bend and vibrate, and the bottom plate 180 may not bend or vibrate together with the bending vibration of the second vibrating plate 160.

Lastly, the description of the above embodiments is to be considered in all respects only as illustrative and not restrictive. The scope of the disclosure is indicated by the appended claims rather than by the foregoing embodiments. All changes that come within the meaning and range of equivalency of the claims are to be embraced within the scope of the disclosure.

C neutral plane
1 inner casing
3 blower space
4 supporting portion
5 outer casing
6 airway
8 second vent
10 plate portion
11 first vent
13 frame plate portion
17 outer casing
20 piezoelectric element
21 diaphragm
22 intermediate plate
24 exit
25 exit
31 airway
36 first blower space
40 piezoelectric element
53 intake
60 first vibrating plate
61 disc portion
62 supporting portion
63, 163 outer terminal
70 side plate
79 lead wire
80 top plate
81 first cavity
82, 83 electrode terminal
100 piezoelectric blower
101 blower main body
110 first casing
120 second casing
131 airway
136 second blower space
160 second vibrating plate
161 disc portion
162 supporting portion 170 side plate
180 bottom plate
181 second cavity
190 intermediate plate
200 piezoelectric blower
300 piezoelectric blower
395 intermediate plate
500 piezoelectric blower
501 blower main body
600 piezoelectric blower
601 blower main body
660 first vibrating plate
900 piezoelectric blower

The invention claimed is:

1. A piezoelectric blower comprising:

a piezoelectric element having a first principal surface and a second principal surface opposed to the first principal surface and including an electrode disposed on each of the first and second principal surfaces;

a first vibrating plate bonded to the first principal surface of the piezoelectric element, the first vibrating plate being configured to be bent and vibrated by the piezoelectric element;

a first casing bonded to a surface of the first vibrating plate opposite to the piezoelectric element, the first casing and the first vibrating plate defining a first blower space, the first casing having a first cavity communicating between the inside and outside of the first blower space;

a second vibrating portion including an intermediate plate bonded to the second principal surface of the piezoelectric element and in contact with the electrode on the second principal surface and a flat plate portion connected to the intermediate plate, the second vibrating portion being configured to be bent and vibrated by the piezoelectric element; and a second casing bonded to a surface of the flat plate portion opposite to the piezoelectric element, the second casing and the second vibrating portion defining a second blower space, the second casing having a second cavity communicating between the inside and outside of the second blower space, the second casing and the flat plate portion of the second vibrating portion being distanced apart from the piezoelectric element, wherein both the first vibrating plate and the intermediate plate include a first principal surface and a second principal surface and each is conductive from the first principal surface to the second principal surface, and wherein an outer diameter of the piezoelectric element and an outer diameter of the intermediate plate are smaller than an outer diameter of the first vibrating plate and an outer diameter of the flat plate portion of the second vibrating portion such that the piezoelectric element bends and vibrates a central portion of the first vibrating plate and a central portion of the flat plate.

2. The piezoelectric blower according to claim 1, wherein the intermediate plate projects from the flat plate portion toward the piezoelectric element.

3. The piezoelectric blower according to claim 1, wherein the intermediate plate has a diameter smaller than a diameter of the second blower space.

4. The piezoelectric blower according to claim 1, wherein the intermediate plate and the flat plate portion in the second vibrating portion are integral with each other.

5. The piezoelectric blower according to claim 2, wherein the intermediate plate has a diameter smaller than a diameter of the second blower space.

6. The piezoelectric blower according to claim 2, wherein the intermediate plate and the flat plate portion in the second vibrating portion are integral with each other.

7. The piezoelectric blower according to claim 3, wherein the intermediate plate and the flat plate portion in the second vibrating portion are integral with each other.

8. The piezoelectric blower according to claim 1, further comprising an outer casing having an inner surface connected to peripheral edges of the first vibrating plate and the second vibrating portion.

9. The piezoelectric blower according to claim 8, further comprising key-shaped portions disposed between the inner surface of the outer casing and the peripheral edges of the first vibrating plate and the second vibrating portion, the key-shaped portions defining openings for allowing air to flow pass the first vibrating plate and the second vibrating portion.

10. The piezoelectric blower according to claim 9, wherein the key-shaped portions extend from the peripheral edges of the first vibrating plate and the second vibrating portion.

11. The piezoelectric blower according to claim 8, wherein the outer casing includes an opening for allowing fluid communication between a surrounding environment and an inner cavity of the outer casing.

12. The piezoelectric blower according to claim 11, wherein the opening is formed in a side wall of the outer casing.

* * * * *